United States Patent [19]

Dunnington et al.

[11] 4,128,971

[45] Dec. 12, 1978

[54] ABRASIVE DRILL

[75] Inventors: Bruce W. Dunnington, Lyndell; William B. Gernert, St. Davids, both of Pa.

[73] Assignee: Glennel Corporation, Chester Springs, Pa.

[21] Appl. No.: 723,153

[22] Filed: Sep. 14, 1976

[51] Int. Cl.[2] ..... B24D 17/00

[52] U.S. Cl. ..... 51/204; 51/309 R; 175/409; 408/145; 408/704

[58] Field of Search ..... 51/206 R, 206 NF, 207, 51/298, 309, 204, 204 R; 175/329, 330, 409; 32/59; 408/145, 199, 704

[56] References Cited

U.S. PATENT DOCUMENTS

| | | | |
|---|---|---|---|
| 1,625,463 | 4/1927 | Gauthier | 51/206 R X |
| 1,634,708 | 7/1927 | Chayes | 51/206 R |
| 1,641,206 | 9/1927 | Smith | 175/330 X |
| 2,324,377 | 7/1943 | Fischer | 51/206 R |
| 2,643,945 | 6/1953 | Buckner | 51/206 NF |
| 3,295,941 | 1/1967 | Spellman | 51/309 X |
| 3,372,010 | 5/1968 | Parsons | 51/309 |
| 3,427,759 | 2/1969 | Kistler | 51/206 NF |
| 3,436,871 | 4/1969 | Schneider | 51/204 R |
| 3,547,608 | 12/1970 | Kitazawa | 51/298 X |
| 3,850,590 | 11/1974 | Chalkley | 51/298 X |

FOREIGN PATENT DOCUMENTS

| | | | |
|---|---|---|---|
| 2300649 | 7/1974 | Fed. Rep. of Germany | 408/145 |

*Primary Examiner*—Gary L. Smith
*Attorney, Agent, or Firm*—Charles A. McClure

[57] ABSTRACT

An abrasive drill of small diameter is provided with a cored portion that is eccentric, i.e., lacking a substantial concentric portion, relative to the longitudinal axis of the drill. The core, regardless of shape, is located so that during drill rotation all of the surface of a workpiece within the outline of the end of the drill is abraded by some part of the rotating end of the drill. The drill composition comprises abrasive particles in a less abrasive matrix, and the core is not hollow but comprises relatively non-abrasive material. The drill is formed by deposition of matrix material entraining abrasive particles onto a taut filamentary mandrel. The mandrel preferably comprises one or more round filaments, either straight or twisted together, alongside the longitudinal axis of the drill, and may be metallic, such as copper wire or may be non-metallic, such as nylon or other synthetic polymeric textile fiber composition. The drill diameter may be on the order of a millimeter or so or smaller.

13 Claims, 10 Drawing Figures

ABRASIVE DRILL

This invention relates to abrasive drills of small diameter.

Conventional core drills are hollow cylindrical members having abrasive or cutting members variously distributed on or in the tubular structure. The core reduces the lateral drilling thickness and permits the injection of coolant or lubricant, resulting in increased drill life and improved economy of operations. However, in small sizes the complementary rodlike portion being removed from the workpiece often has insufficient structural integrity and breaks into pieces large enough to jam the drill, thereby forfeiting the advantages of core drilling.

A primary object of the present invention is provision of a small-diameter of "micro" abrasive drill with a cored portion that extends its usability to smaller dimensions than feasible in conventional core drills.

Another object of this invention is provision of a cored abrasive drill that disintegrates the entire portion of material being removed from a workpiece by means of such drill.

A further object of the present invention is a method of forming such cored drills.

Other objects of the present invention, together with means and methods for attaining the various objects, will be apparent from the following description and the accompanying diagrams, which are presently by way of example rather than limitation. All views are larger than actual size.

Figure 1:
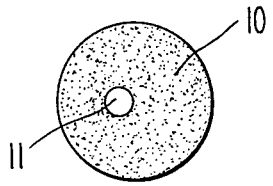
Figure 2:
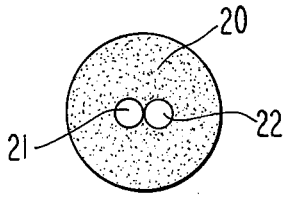
Figure 3:
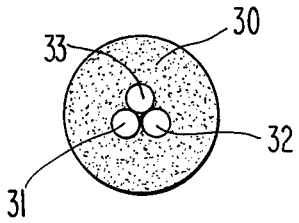

FIG. 1 is an end elevation of a first embodiment of cored drill according to this invention, in which the eccentric core has the configuration of a simple cylinder tangential to the longitudinal axis of the drill;

FIG. 2 is an end elevation of a second embodiment of cored drill according to this invention, in which the eccentric core has the configuration of a pair of simple cylinders mutually tangential to one another and to the longitudinal axis of the drill; and FIG. 3 is an end elevation of a third embodiment of cored drill according to this invention, in which the eccentric core has the configuration of three simple cylinders mutually tangential to one another and to the longitudinal axis of the drill.

Figure 4:
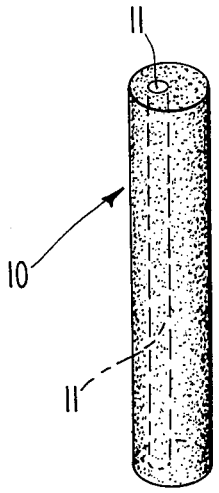
Figure 5A:
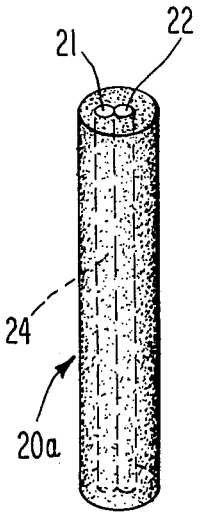
Figure 5B:
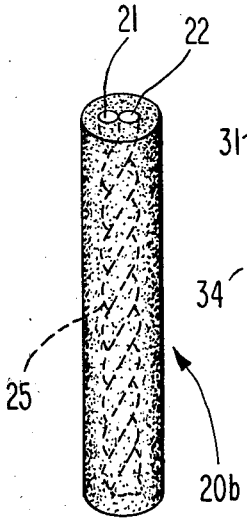
Figure 6A:
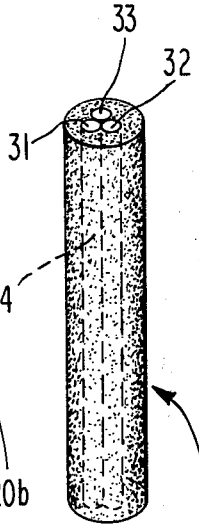
Figure 6B:
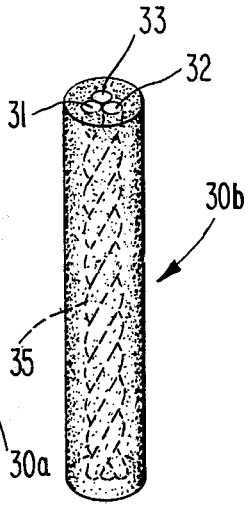

FIG. 4 is a perspective view of the cored drill of FIG. 1, with a broken-line showing of the core inside;

FIG. 5*a* is a perspective view of a first example of the cored drill of FIG. 2, with a broken-line showing of the core inside, both the cylinders being straight;

FIG. 5*b* is a perspective view of a second example of the cored drill of FIG.. 2, with a broken-line showing of the core inside, the core cylinders being twisted around one another and the longitudinal axis of the drill;

FIG. 6*a* is a perspective view of a first example of the cored drill of FIG. 3, with a broken-line showing of the core inside, the three core cylinders being straight throughout; and FIG. 6*b* is a perspective view of a second example of the cored drill of FIG. 3, with a broken-line showing of the core inside, the three core cylinders being twisted together about the longitudinal axis of the drill.

Figure 7:
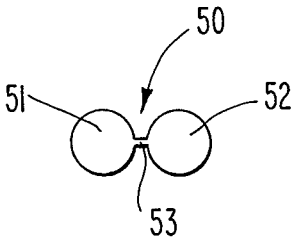
Figure 8:
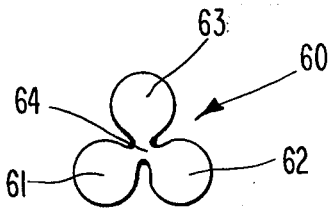

FIG. 7 is an end view of a unitary two-lobed core filament useful as a mandrel in the drills of FIGS. 5*a* and 5*b* in place of juxtaposed individual filaments; and FIG. 8 is an end view of a unitary three-lobed core filament useful as a mandrel in the drills of FIGS. 6*a* and 6*b* in place of juxtaposed individual filaments.

In general, the objects of the present invention are accomplished via a cylindrical drill having a cored portion that is eccentric, i.e., lacking a substantial concentric portion, relative to the longitudinal axis of the drill. The drill composition comprises abrasive particles in a less abrasive matrix, and the cored portion comprises relatively non-abrasive material.

The drill is formed by deposition of matrix material entraining abrasive particles onto a taut filamentary mandrel, which preferably comprises one or more round filaments, either straight or twisted together, alongside (e.g., tangential to) the longitudinal axis of the drill. The filaments may be metallic, such as copper wire, or may be non-metallic, such as nylon or other synthetic polymeric textile fiber composition. The deposition step forms the cylindrical drill outline to the desired diameter, which may be on the order of a millimeter or so or 10ths thereof.

FIGS. 1, 2, and 3 show in end elevation three alternative embodiments of cored drill, according to this invention, characterized by core outlines of one, two, and three circles, respectively, being the transverse cross-sectional outlines of the respective cores. Each such outline is tangential to the longitudinal axis of the drill, and the second and third have corresponding two-lobe and three-lobe configurations. Thus, FIG. 1 shows an end (round) of drill 10 having as an eccentric core mandrel simple cylindrical filament 11 tangential to the longitudinal axis of the drill (in this view, the center of the end). FIG. 2 shows an end of drill 20 having as a core mandrel a pair of simple cylindrical filaments 21, 22 mutually tangential to one another and to the drill axis. FIG.. 3 shows an end of drill 30 having as a core mandrel three simple cylindrical filaments 31, 32, 33 mutually tangential to one another and to the drill axis. The drills are shown stippled to suggest their content of abrasive particles.

FIG. 4 shows drill 10 of FIG. 1 in perspective, with cored portion 11 shown in broken lines (inside) as a straight cylinder tangential to the drill axis.

FIGS. 5*a* and 5*b* show two variants of the drill of FIG. 2, in which the cylinders of the cored portion (shown in broken lines inside) are, respectively, straight and twisted around one another while remaining tangential to the drill axis. Thus, in FIG. 5*a*, composite two-lobed core 24 is straight, while in FIG. 5*b* similar two-lobed core 25 is helical.

FIGS. 6*a* and 6*b* show two variants of the drill of FIG. 3, in which the cylinders of the cored portion (shown in broken lines inside) are, respectively, straight and twisted together while remaining tangential to the drill axis. Thus, in FIG. 6*a*, composite three-lobed core 34 is straight, while in FIG. 6*b* similar three-lobed core 35 is helical.

Although plural round filaments have been disclosed in forming multi-lobed mandrels, it is apparent that single non-round filaments of similar overall shape could be used instead, being produced by drawing of metal through suitably shaped dies or extrusion of fiber-forming compositions through correspondingly shaped spinnerets. Examples of a two-lobed filament and a three-lobed filament useful as such mandrels appear end-on in FIGS. 7 and 8, respectively. Thus, in FIG. 7, filament 50 has left lobe portion 51 and right lobe portion 52 joined by intervening web portion 53. Similarly, in FIG. 8, filament 60 has three lobes 61, 62, and 63 at 120 degrees of arc from one another joined by intervening web portion 64. Although the respective web portions are concentric with the drill axis they are so small relative to the core lobes as to be insubstantial, whereupon drills with such cores will not leave undisintegrated portions of a workpiece but will abrade essentially all the surface thereof within the outline of the rotating end of such drill.

In summary, the drills of this invention are made possible by first selecting, arranging, and tautening the mandrel filament(s). Thus, if more than one such filament is to be used as the mandrel, they are juxtaposed laterally to one another and optionally twisted, depending upon whether an "a" type or "b" type of core is desired. Suitable filament diameter is from about one-twentieth to one-third the desired diameter of the resulting drill. The filament(s) may be tautened by heating, stretching till taut, and cooling under tension. Metallic filaments may be resistance-heated by passing electrical current therethrough.

Then, the mandrel receives abrasive particles entrained in an electrically conductive matrix material to form the drill (to the desired diameter). Electroforming is readily carried out by deposition from a nickel solution in which the abrasive particles are suspended or at least circulating. As an alternative to cathodic deposition, electroless chemical reduction may be employed. Such techniques are well known in the art, and as their details need be merely conventional they will not be specified here. When electrically non-conductive mandrel materials are employed they can be coated with graphite or conductive adhesive materials to assist in the deposition process.

With a single off-axial cylindrical mandrel, access of abrasive thereto will be graduated circumferentially to locate the core eccentrically as desired in a resulting cylindrical (round cross-section) drill. When plural filamentary or single multi-lobed mandrels are employed, uniform access of matrix material and abrasive particles to the mandrel is permitted, with the desired circular cross-section facilitated otherwise, as by rotation of the mandrel, not an uncommon technique.

The abrasive particles may be diamond, cubic boron nitride, alumina, tungsten carbide, or other recognized abrasives, such as oxides, carbides, or nitrides. Diamond is preferred because of its superior hardness and ready availability in desired size range. Cubic boron nitride is also very hard and, being more resistant to high temperatures, is useful in drilling metals, such as tool steel. The drills of this invention are most useful in drilling non-metals, usually hard brittle materials, such as ceramics and gemstones (both artificial and natural), which are difficult to drill by other means and methods and which tend to crumble when abraded. Thus, an insubstantial concentricity of core in such drills ensures that such materials being drilled do not leave any central undrilled fragments, for lateral abrasion by the cusplike portions of the drill body between the respective lobes of the core crumbles the axial fragments.

A suitable range of particle size is from about a ten-thousandth to a half of the drill diameter. Thus, for a drill 1 or 2 millimeters in diameter, such particles could range from about one-tenth to 1000 microns in "diameter" and preferably from about 30 to 300 microns. Practical diameters for "micro" drills of this invention are on the order of a millimeter or so or even 10ths of a millimeter.

Although certain embodiments of this invention have been illustrated and described, other modifications may be made, as by adding, combining, or subdividing parts or steps, or by substituting equivalents, while retaining advantages and benefits of the invention, which itself is defined in the following claims.

The Claimed Invention:

1. A cylindrical abrasive drill having an eccentric longitudinal solid, relatively non-abrasive cored portion throughout.

2. Drill according to claim 1, comprising diamond particles as abrasive material.

3. Drill according to claim 2, wherein the particles are embedded in a matrix of less abrasive material extending throughout the drill cross-section except at the core.

4. Drill according to claim 1, having a diameter on the order of 10ths of a millimeter to about a millimeter in extent.

5. Drill according to claim 4, wherein the greatest transverse dimension of the core is between about one-twentieth and one-third the drill diameter.

6. A cylindrical drill comprising particles of abrasive material and having an eccentric longitudinal solid, relatively non-abrasive cored portion lacking any substantial concentricity relative to the longitudinal axis of the drill.

7. Drill according to claim 6, wherein the cored portion comprises at least one metallic filament.

8. Drill according to claim 6, wherein the cored portion comprises at least one synthetic polymeric filament.

9. In a method of forming the drill of claim 6, the steps of selecting a filamentary member of substantially uniform cross-section and depositing thereon material comprising abrasive particles to obtain a substantially cylindrical article having the longitudinal member as the cored portion, located substantially tangential to the longitudinal axis of the drill and otherwise off the axis.

10. Method of forming a cylindrical drill having an eccentric longitudinal cored portion and otherwise made up of substantially uniform composition thereacross including abrasive particles in a less abrasive matrix, comprising providing filamentary means as a core mandrel, depositing thereon the matrix material with the abrasive particles entrained therein to obtain a cylindrical outline of drill with the longitudinal axis thereof extending alongside the resulting longitudinal cored portion.

11. Drill formed by the method of claim 10.

12. Method of forming a cylindrical drill having an eccentric solid, relatively non-abrasive core, comprising providing filamentary means lacking a substantial portion concentric with the longitudinal axis of the drill, and depositing abrasive material thereon to obtain a cylindrical outline.

13. Drill formed by the method of claim 12.

* * * * *